US007166795B2

(12) United States Patent
Lengeling

(10) Patent No.: US 7,166,795 B2
(45) Date of Patent: Jan. 23, 2007

(54) METHOD AND APPARATUS FOR SIMULATING A MECHANICAL KEYBOARD ACTION IN AN ELECTRONIC KEYBOARD

(75) Inventor: Gerhard Lengeling, Los Altos, CA (US)

(73) Assignee: Apple Computer, Inc., Cupertino, CA (US)

( * ) Notice: Subject to any disclaimer, the term of this patent is extended or adjusted under 35 U.S.C. 154(b) by 178 days.

(21) Appl. No.: 10/805,450

(22) Filed: Mar. 19, 2004

(65) Prior Publication Data

US 2005/0204906 A1 Sep. 22, 2005

(51) Int. Cl.
*G10H 1/02* (2006.01)

(52) U.S. Cl. ..... 84/737; 84/439; 84/744

(58) Field of Classification Search ..... 84/645, 84/737, 743, 744, 439, 440
See application file for complete search history.

(56) References Cited

U.S. PATENT DOCUMENTS 5,189,242 A * 2/1993 Usa ..... 84/743
5,922,983 A * 7/1999 Muramatsu ..... 84/626
6,337,678 B1 * 1/2002 Fish ..... 345/156
6,647,359 B1 * 11/2003 Verplank et al. ..... 703/2
6,693,626 B1 * 2/2004 Rosenberg ..... 345/168
6,703,550 B1 * 3/2004 Chu ..... 84/609
6,900,379 B1 * 5/2005 Eugene et al. ..... 84/103

* cited by examiner

*Primary Examiner*—Jeffrey W Donels
(74) *Attorney, Agent, or Firm*—Hickman Palermo Truong & Becker LLP

(57) ABSTRACT

An electronic keyboard simulates the keyboard action of one or more acoustic pianos and/or organs. Sensors associated with each key capture the force exerted on the key, the speed of the key and the position of the key to compute an amount of force to apply in feedback to the depressed key. An actuator associated with each key provides the computed feedback value as a counter-force to the player's finger pressure. Feedback may be computed in one or more processors by applying the sensor readings to a system model of the desired instruments mechanical key action. Also, feedback may be determined through a lookup table containing feedback values defining a particular instrument's action. The player can switch between different instrument action definitions as desired, and may tune certain parameters to achieve a customized action.

21 Claims, 4 Drawing Sheets

METHOD AND APPARATUS FOR SIMULATING A MECHANICAL KEYBOARD ACTION IN AN ELECTRONIC KEYBOARD

BACKGROUND

1. Field of the Invention

This invention relates to the field of electronic music instruments, and more specifically, to the keyboards of electronic music instruments.

2. Background Art

The evolution of the electronic keyboard has empowered musicians by eliminating the need for pianists and organists to have bulky, substantially immovable pianos or organs available for practice and performance. Electronic keyboards are small, relatively lightweight, inexpensive, and, in the case of advanced synthesizers, able to simulate the sound of any existing instrument (or any sound source, for that matter). They are easy to transport, easy to set up, and available for impromptu practice or performance in any location. Unfortunately, in eliminating the disadvantages of pianos and organs, electronic keyboards have also eliminated the "feel" of playing a piano or organ. Many musicians prefer the feel of a piano keyboard to that of an electronic keyboard. Further, because the action is different, performance techniques may also vary with respect to playing on a piano keyboard and an electronic keyboard.

The feel of a piano or organ comes from the mechanical action of converting the depression of a key into the striking of a string in a piano or the actuation of an air valve in a pipe organ. The tactile feedback a musician receives from the keyboard action of a piano or organ aids in the musician's control over the qualities of the note played (e.g., the volume of the note and the intensity of the attack). When the musician is playing on an unfamiliar type or brand of piano, the playing may feel "off" because the tactile feedback is not consistent with the musician's learned expectations. The resulting audio qualities of the performance may differ from expectations as well (notes may be too hard or soft sounding because the attack is too strong or weak, and the musician's control of the volume may be diminished). The discomfort and lack of control are even greater when the musician switches to an electronic keyboard in which the familiar mechanical action of a piano or organ keyboard is absent.

A pipe organ generates sounds by channeling pressurized air through one or more selected pipes. The dimensions of the pipe determine the pitch (sound frequency) of the note played, and the air pressure determines the volume. On an organ keyboard, each key actuates an air valve that releases pressurized air into one of the pipes. The amount of key depression determines the amount of air released, and hence the volume of the note played. The keyboard action of the pipe organ is a function of the valve mechanics and the force of the released air on the valve. An electric organ, in contrast, has a key action that is substantially linear in nature, having a constantly increasing resistance force similar to compressing a spring.

In a piano, the properties (length and tension) of a string determine its specific resonance, and therefore the note that may be played by striking the string. Each key of the piano keyboard is the end of a lever set on a fulcrum, the opposing side of which is weighed down by a hammer element. Depression of the key causes the lever to push the hammer toward a particular string. A certain momentum threshold is needed for the hammer to strike the string. Greater momentum will result in a louder note. In addition to swinging the hammer, each key also controls a damper. When the key is held down, the damper is held away from the string. Whereas, when the key is released, the string is damped, causing the string oscillations to diminish more quickly. The mechanics of the damper and the hammer thus contribute to the action or feel of the piano keyboard.

As may be expected, different types of pianos have different mechanics with different keyboard action. For example, the mechanics of a grand piano differ from those of an upright piano. Also, pianos from different makers may also have differences in keyboard action due to differences in hammer mass, lever ratio, and/or damper tension. A musician will feel the most comfortable playing a piano with a familiar keyboard action.

In contrast to pianos and organs, most electronic keyboards and synthesizers have very little action at all. There is no need for a complicated hammer/lever apparatus because the sound is electronically generated. Typically, the keys of an electronic keyboard are hinged on one end, with a spring underneath to return the key to its rest position. The resistance is relatively constant. An electrical contact is sufficient to initiate a sound, and the sound continues to play as long as that contact is maintained (i.e., by holding the key down. The velocity of the key may be detected to provide an initial note volume, but the action of the keyboard does not change with velocity.

Some electronic keyboards attempt to mimic the mechanical characteristics of an acoustic piano, for example, by including hammer-like elements that strike a backing of foam rubber. This mechanical mimicry is an improvement over keyboards with no real action. However, this keyboard action is unlikely to match that of a musician's favorite type and brand of piano. Also, the additional mechanical elements increase the size and weight of the electronic keyboard. Therefore, there is a need for an electronic keyboard that provides the keyboard action of a musician's favorite piano without the added bulk of mechanical elements.

SUMMARY OF THE INVENTION

The invention is a method and apparatus for simulating the key action of one or more acoustic keyboard instruments in an electronic keyboard. Embodiments of the invention may utilize one or more sensing devices for each key on the keyboard, to capture positional data for each depressed key of the keyboard. The data thus captured may be fed to one or more processors in which the positional data may be used to determine the current kinetic state of a respective depressed key. Based on a particular acoustic keyboard profile or set of model parameters, an appropriate resistance force is determined from the current kinetic state, and an actuator is driven to provide that resistance force to the depressed key.

In one or more embodiments of the invention, the actuators providing the key resistance force may be implemented with electromagnets in a push and/or pull mode, where the level of drive current in the electromagnet determines the applied resistance force. The sensors may be, for example, magnetic (e.g., Hall effect sensors) or optical (e.g., optical encoder) in nature. Also, by measuring the current induced by a ferromagnetic core moving through an energized coil, the actuator itself can be used for sensing current kinetic state of the key.

In one embodiment, the appropriate resistance force is determined by accessing a lookup table indexed by parameters of the current kinetic state. The force values in the lookup table correspond to the action (i.e., key behavior) of a specific acoustic keyboard instrument. Multiple keyboard profiles may be stored as multiple lookup tables. In an alternate embodiment, software within the processor may implement a general mathematical model of the action associated with a particular type of piano or organ. Certain parameters of the model would then be stored in a table referenced by model and/or brand of piano or organ. Examples of those parameters may include hammer mass, lever ratio, damper resistance, and possibly position values where known force non-linearities occur. The force value computed by the model may then be converted into an appropriate drive signal for the key actuator.

Embodiments of the invention also allow a user to modify the configuration parameters to allow for fine-tuning of model parameters to achieve a given mechanical action. A custom key action may be generated, including behaviors that do not currently exist or are impossible to implement mechanically. The simulation system may be enhanced through model updates and additional keyboard characterizations downloaded over a network, loaded via CD-ROM or other removable media, or provided with a firmware upgrade (e.g., replacement of a EPPROM).

DETAILED DESCRIPTION

A method and apparatus for simulating the key action of acoustic keyboard instruments are described. In the following description, numerous specific details are set forth to provide a more thorough description of the invention. It will be apparent, however, to one skilled in the art, that the present invention may be practiced without these specific details. In other instances, well known features have not been described in detail so as not to obscure the present invention. The claims, however, are what define the metes and bounds of the invention.

1. Overview

Embodiments of the invention provide an electronic keyboard in which each key is interactively coupled with one or more electromechanical devices, enabling each key to exert resistance force consistent with the keyboard action of acoustic instruments. The keyboard player may choose from among a set of program models and/or keyboard profiles to obtain the keyboard action desired. In addition, the parameters associated with a given acoustic keyboard instrument may be adjusted to define a new, custom keyboard action.

A keyboard player may utilize a single keyboard to play in different styles, consistent with playing different keyboard-based music instrument (e.g. a grand piano, an organ or any type of keyboard-based music instrument) without having to switch between physical keyboards. Furthermore, multiple players may use the same electronic keyboard, while experiencing the specific keyboard action with which they are the most comfortable.

Embodiments of the invention utilize one or more mechanical sensing devices, one or more mechanical actuators and electronic circuitry to implement the invention. The sensing devices provide dynamic data (e.g. position, force, etc.) that is provided to processor circuitry for computing for each depressed key an expected resistance force that is consistent with a mechanical keyboard profile or definition. For each depressed key, a drive control signal is provided to an actuator to apply the computed resistance force to the key.

2. System Components

Figure 1A:
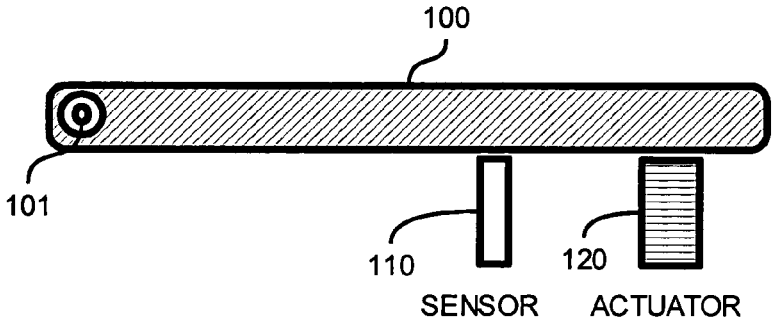
FIGS. 1A and 1B illustrate two implementations of a key with a sensor and actuator in accordance with embodiments of the invention.
Figure 1B:
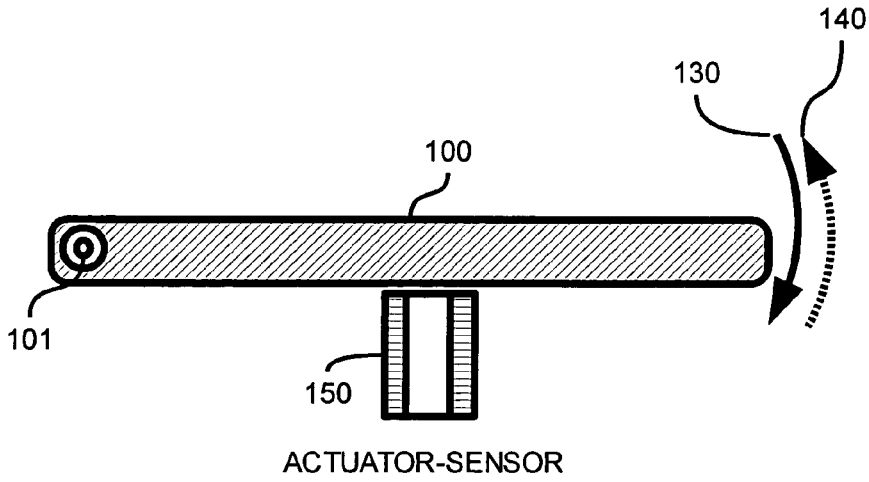

FIGS. 1A and 1B illustrate the implementation of electromechanical devices in accordance with one or more embodiments of the invention. FIG. 1A depicts a key 100 of a keyboard separately coupled with a sensor 110 and an actuator 120. The keyboard key 100 is also coupled with a support system through a coupling 101. The support coupling may be as simple as a connecting axis (as exemplified in FIGS. 1A and 1B) to allow the key to rotate about the axis. The coupling may also comprise mechanical elements configured to allow for translation movements (e.g. as in a grand piano) or any other key movements required to properly emulate a mechanical keyboard or generate specific mechanical properties sought by the keyboard player.

In embodiments of the invention, one or more motion sensing devices 110 may be placed in the vicinity of each key. For example, an optical encoder sufficient to capture the range of rotation about the hinge axis may be implemented at any point along the key structure. Similarly, a magnet may be attached to the key at any point, with one or more magnetic sensors placed in a corresponding arc adjacent to the magnet location. The motion sensing devices may be configured to sense any or all of the kinetic properties of the key movement. For example, a sensing device or a combination thereof may capture the data for position, velocity and acceleration.

Sensor 10 typically comprises a transducer that allows for converting captured mechanical data into electrical signals. Sensor 10 may further comprise an analog-to-digital converter for converting analog electrical signals into digital data that can be transmitted to and processed by a digital processor, for example. Embodiments of the invention may utilize any available static and kinetic data capturing device.

The keyboard key 100 is also coupled with one or more actuators 120. An actuator may be any device capable of receiving a signal (e.g. electrical or optical signal) and producing a mechanical action. One example of an actuator is an electromagnet that comprises a core (e.g. a ferromagnetic rod) and a conductive coil. Embodiments may utilize any actuator available in the industry to provide movement control of the key 100 such as pneumatic, piezoelectric actuators or any other actuator available.

Embodiments of the invention may also utilize one or more actuators to control the translation movement, as mentioned above, to emulate a specific type of mechanical behavior.

Embodiments of the invention may utilize actuators that implement electronic circuitry to control movement. For example, the actuator may comprise one or more electronic circuits capable of executing a variety of actions based on input (e.g., drive current) to the circuit. Actuators may also comprise a digital processor, memory and embedded instructions (or computer programs). In one or more embodiments of the invention, an actuator may receive direct input from one or more sensors. Furthermore, actuators may receive input from sensors located on the same key, and from sensors located on adjacent or distant keys on the keyboard.

FIG. 1B depicts an arrangement of a key and an actuator-sensor device in accordance with one or more embodiments of the invention. The actuator-sensor 150 may be a combined device that allows for sensing movement and producing force. For example, the actuator-sensor device 150 may be an electromagnet that induces electric current when the core is moved through the coil, and produces movement of the core when electric current is passed through the conductive coil. By measuring and controlling the value of the current passing through the conductive coil, embodiments of the invention may use an electromagnet, solenoid or similar device as a combined actuator-sensor device. For example, when a keyboard player presses a key down producing movement 130, a sensor or the sensing portion of an actuator-sensor device captures the static and dynamic data of the key to convey it to an electronic circuit or to a digital processor. For instance, the induced current, resulting from a ferromagnetic core attached to the key being forced backward through the solenoid coil, may be detected by sensing the current in the conductive coil and subtracting out the known contribution from the most recent control current. The remaining current is caused by the depression of the key, and may be used to compute a new output value for the control current. The actuator control output of the electronic circuit or the digital processor is transmitted to one or more actuators to provide a force 140. The force may move the key or simply provide a controlled resistance to simulate the desired key action.

3. Method for Providing Resistance Force

Figure 2:
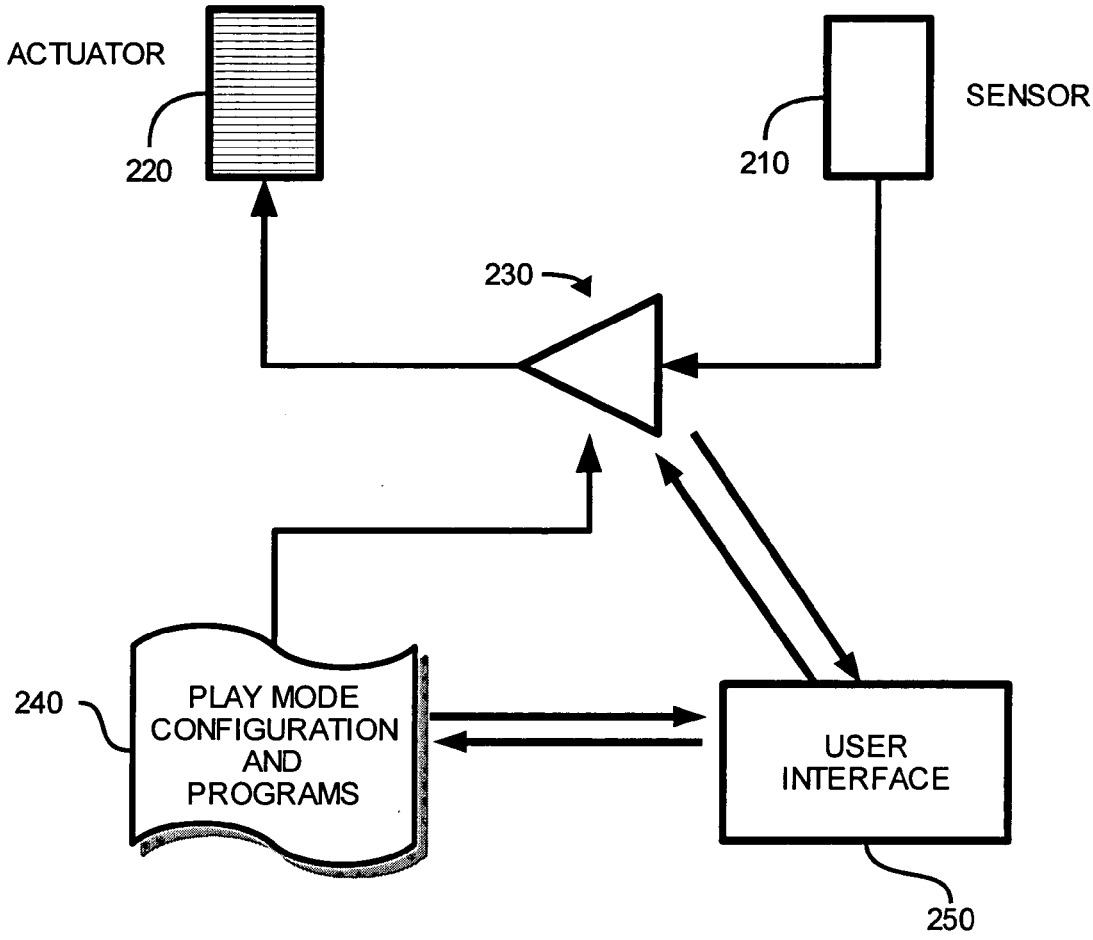
FIG. 2 is block diagram of closed-loop action simulator circuit in accordance with one or more embodiments of the invention.

FIG. 2 is block diagram of an embodiment of the invention. Motion sensing device 210 captures motion data at one or more locations along one or more keys of a keyboard. Processor 230 receives input from sensing device 210 and computes a resistance force value. Processor 230 may comprise a general processor or a digital signal processor, or one or more suitably configured programmable logic devices (e.g. field-programmable gate arrays (FPGA)). Processor 230 may be configured to receive inputs from one or more motion sensing devices and to produce outputs capable of driving one or more actuators. Processor instructions, keyboard action models, and keyboard profiles/parameters may be stored in random access memory. In some embodiments, processor 230 may be implemented by a connected computer system, such as a personal computer having a processor, memory, storage devices and one or more electronic interfaces to control the electronic keyboard.

Processor 230 is enabled to utilize one or more data sources (e.g. 240) to determine parameters for computing output force data. Data sources may include, for example, data stored in the processor's flash memory or in one or more storage circuits (e.g., an EPROM) coupled to processor 230. A data source may also be a data file (e.g. an ASCII or a binary file) stored in a non-volatile memory device (e.g., a magnetic or optical disk drive) or any other data source. In one or more embodiments of the invention, the parameter data 240 is used within processor 230 to compute the resistance force from the sensor input.

As an example of the mathematical model approach to force computation, processor 230 may implement the following force model:

$$\text{Force}_R(n)=[F_H(M_H, P_k(n), V_k(n))+F_D(K_D, P_k(n))]\times L$$

Where $\text{Force}_R(n)$ is the resistance force value for the current sample period "n"; where $F_H$ is the force component due to the hammer mechanics, which is shown here as a function of the hammer mass parameter ($M_H$), the current key position sample ($P_k(n)$) and the current key velocity value ($V_k(n)$: either sensed or derived from current and former position samples); where $F_D$ is the force component due to the damper mechanics, which is shown as a function of a damper "spring" constant ($K_D$) and the current key position sample ($P_k(n)$); and where L is the lever ratio (length from hammer or damper to fulcrum divided by the length from "finger tip" to the fulcrum).

In this example model, the parameters stored for a given keyboard action may be $M_H$, $K_D$ and L, for example. Further parameters may also be added to the above model, such as to define non-linearities in the hammer force function. The invention is not limited to the model described. In some embodiments, multiple models may be loaded into the electronic keyboard that will more accurately model the exact mechanics of the desired acoustic keyboards. The model itself may be implemented as a series of instructions executed by the processor. It is also possible to represent models directly in digital logic. Different models might then be made available by, for example, inserting different circuit cards into a slot in the keyboard that permits communication with processor 230.

The force function may also be defined as a function of sensor inputs, such as key position, velocity and/or acceleration. Force values for different combinations may then be pre-computed and stored in a lookup table for instant reference in real time. Different lookup tables may be stored for different keyboard profiles. The granularity of the pre-computed values should be sufficient to provide a musician with a smooth keyboard action, though simple filters may be used for post-processing the resistance value to smooth the response.

Table lookups may also be combined with the model approach, where the model is used initially to compute the feedback resistance value, but the results are stored in the lookup table. Then, as similar inputs are encountered, the lookup table may be used to access the pre-computed values. Where the musician tends to play the same style of music, such that the keys are consistently depressed in the same manner, the trained lookup table approach may be very efficient.

Referring again to FIG. 2, block 220 represents an actuator operatively coupled to a key on a keyboard of a music instrument. Actuator 220 may be designed with certain inherent mechanical properties. For example, an actuator may be equipped with a spring that provides a given level of basic resistance force (even when the power is off or the feedback is disabled).

Block 250 represents a user interface that allows a user to interact with a system embodying the invention. User interface 250 may comprise a set of buttons and displays implemented in a control panel of the electronic keyboard, allowing a user to perform a number of interactions with the system, such as selecting a profile from a menu of choices of keyboard types to be simulated, inputting new parameters, and/or modifying existing ones.

The user interface 240 may also be a graphical user interface (GUI) of a personal computer. In this case, the user may use the GUI to input data, which is then stored locally and/or transmitted to a processor in the electronic keyboard. Other embodiments of the invention may support both a built-in user interface and a graphical interface through a personal computer.

Figure 3:
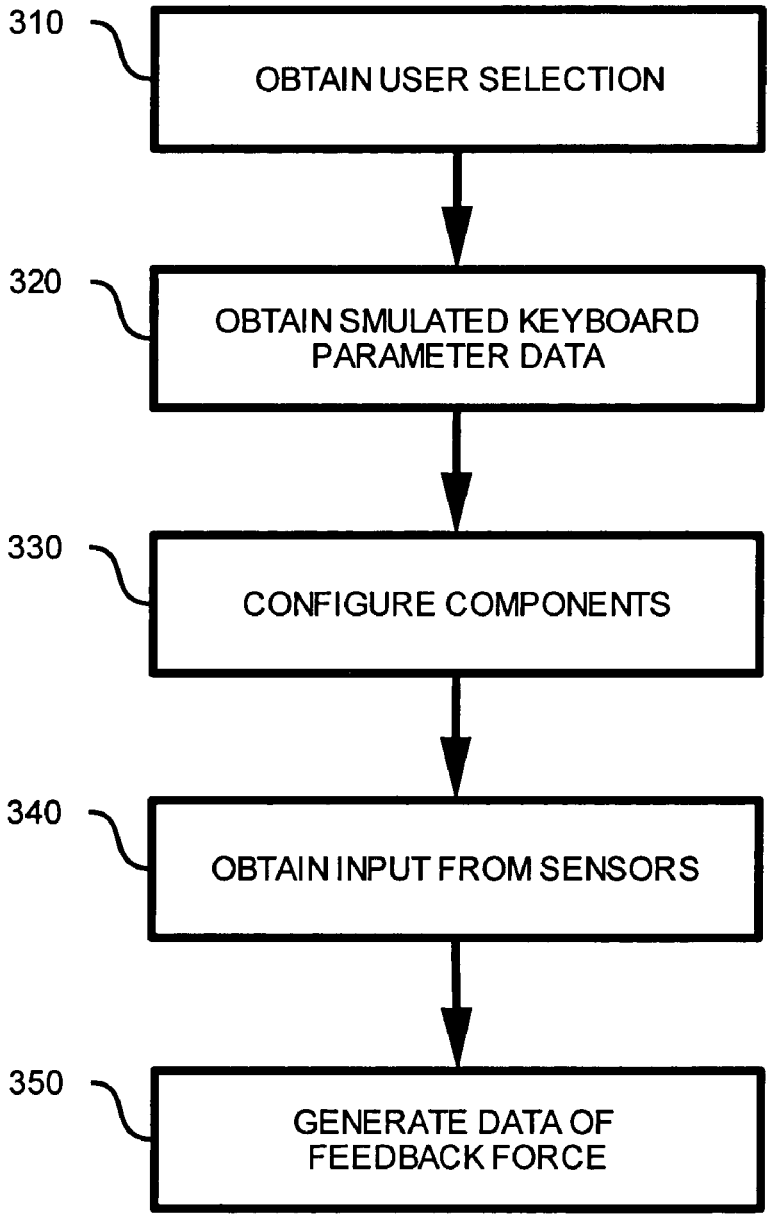
FIG. 3 is a flow diagram illustrating a process for configuring and utilizing an electronic keyboard in accordance with an embodiment of the invention.

FIG. 3 is a flow diagram of a process for configuring and utilizing an electronic keyboard, in accordance with an embodiment of the invention. At step 310, a system embodying the invention obtains a user selection of a simulated mechanical keyboard. For example, the user may utilize a user interface (e.g. 250) to select from a menu of choices. At step 320, the system accesses one or more data sources to load the parameters corresponding to the selected keyboard. The parameters may be used by the processor (e.g. 230) to compute the output, which drives one or more actuators (e.g. 210). As previously stated, the parameters may alternatively comprise a keyboard action profile stored as a lookup table. For example, the lookup table may comprise stored resistance values indexed by one or more kinetic parameters (e.g., position, velocity, most recent resistance value, etc.).

At step 330, the system may utilize the parameters loaded from the data source to configure system components. For example, the system may load embedded code into the sensors, the actuators or any other component capable of being configured to provide a customized action and/or response to its input. For example, the actuators may be capable of providing a certain level of initial force following a single instruction indicating a force level, and without requiring a sustained input from a processor.

At step 340, the system obtains input data, which typically results from a keyboard player depressing one or more keyboard keys. When a key is depressed, one or more sensors send their output data to the processor 230. At step 350, the system generates the feedback force data, which is transmitted to the appropriate actuators (i.e., the actuators associated with the depressed key) to generate the specified resistance force, in conformance with the expected action of the selected keyboard.

Figure 4:
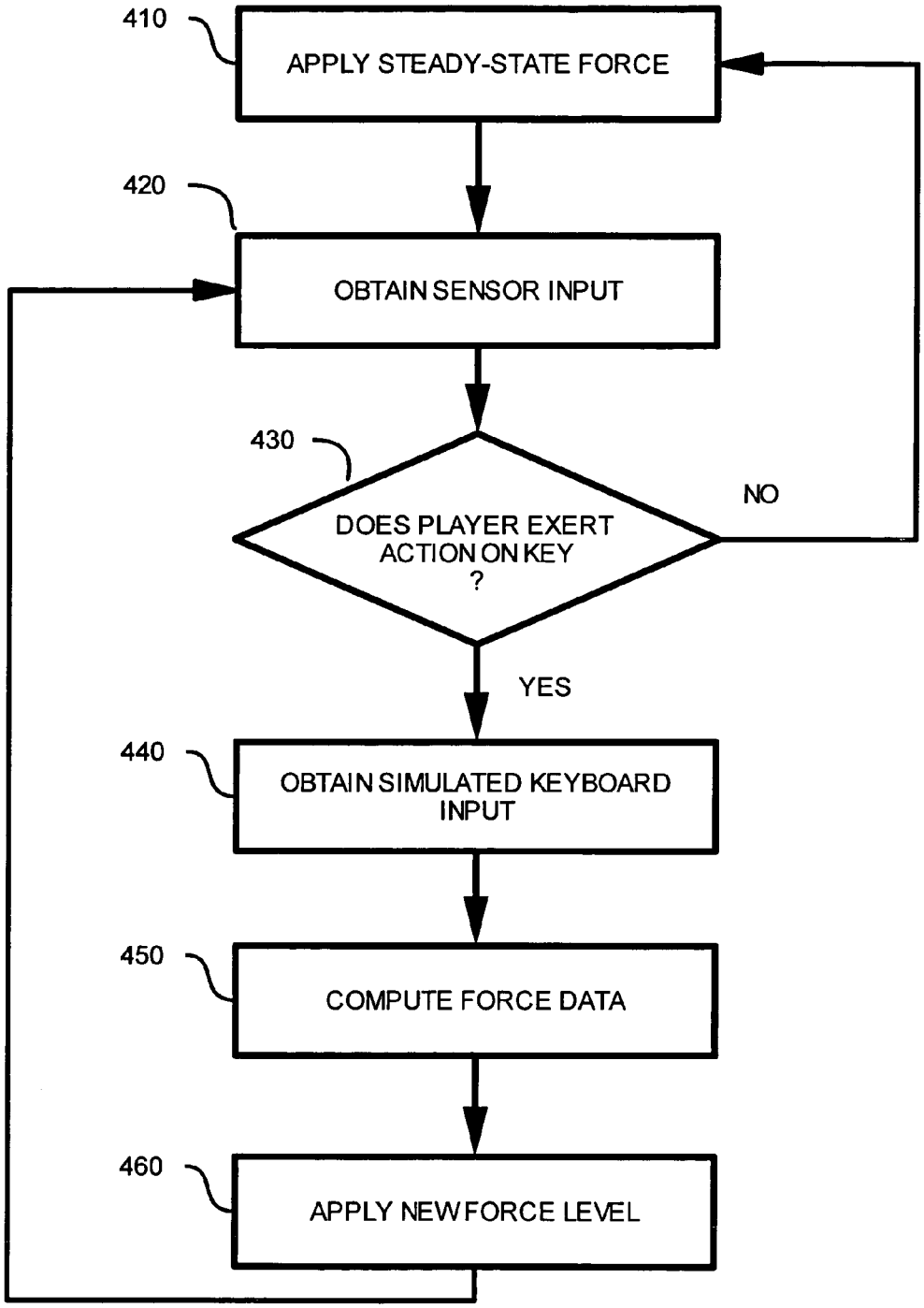
FIG. 4 is a flow diagram illustrating a process for capturing kinetic key data and simulating the mechanical action of an acoustic keyboard in accordance with an embodiment of the invention.

FIG. 4 is a flow diagram of a process for capturing motion data and producing mechanical effects to simulate one of several mechanical keyboards, in accordance with an embodiment of the invention. At step 410, a system embodying the invention applies a steady-state force to one or more keys. The system utilizes the latter step to provide the initial feel of the keys. At step 420, the system captures kinetic data from one or more sensors of one or more keys, and may convert the kinetic data into a format compatible with the processing functions of the processor (e.g. 230). Alternatively, the conversion may be carried out by processor 230, if required.

At step 430, the system checks the input data to determine whether a player has started depressing a key. The player may exert an action on a key in one of several manners. The player may push a key, release it by stopping any contact with the key, perform a controlled release (e.g. by slowly releasing a key) or maintain a depressed key at a certain position. Embodiments of the invention may sense those actions and respond in real time with the appropriate resistance.

When the system determines that the player has started depressing a key, the system obtains keyboard parameter data, at step 440. The system may execute program code for computing resistance force values and/or access a lookup table (e.g. a sorted table or a hash table) that stores pre-computed or empirically determined responses to input data or any other information that will facilitate the simulation of a particular keyboard. At step 450, the system may compute the actuator drive signals needed to provide the expected resistance force.

At step 460, the system transmits the output of the processor to one or more actuators to act on one or more keys. The system then returns to data-capture mode at step 420. The computation and sensing may be asynchronous (e.g., using an event trigger approach) or synchronous (using a clocked approach), or some combination of both (e.g., processing triggered by a sensed key depression event, and completed in synchronous fashion).

For the most accurate and responsive performance, each key may have its own associated processor or computation circuit. For example, each key may have an integrated circuit with logic that implements a mathematical model of an acoustic piano. Keyboard specific parameters of the mathematical model may be loaded into each integrated circuit during a configuration mode, when a particular keyboard action is selected.

For the least expensive approach, a single processor may perform resistance computations for all keys. This implementation may be most responsive when using a lookup table approach, where the number of processor cycles needed to process each key action is minimized.

In another embodiment, multiple processors may be utilized, but fewer than the number of keys on the keyboard. Unless a pianist is playing with a partner, the maximum number of keys that are likely to be depressed at any time is ten (i.e., ten fingers—ten keys). Thus, ten processors, for example, may be used to service depressed keys. A dispatch circuit may be used to monitor available processors and direct active sensor inputs to, for example, the first available processor on a list (or queue) of available processors. When a processor completes a feedback cycle (i.e., a formerly depressed key is no longer depressed), the processor may add itself to the bottom of the "available processor" list.

In one or more embodiments of the invention, the system may compute force data in the context of the movement. For example, the system may capture input data at a given instant, and utilize that data to preemptively compute the force data which may be applied after a given time interval. The system may be enabled to determine playing styles (e.g. soft or aggressive) and utilize the preemptive computation approach to fine-tune the key's reaction.

In an embodiment of the invention, the system may utilize an algorithm able to anticipate key movement before a player touches the key. The latter may be achieved by using data directly from an encoded music file. The system may further analyze the playing style of the player with regard to the encoded music. For example, the system may utilize a probability table using the encoded music in combination with the playing style data to preemptively anticipate key movement and compute the force data that needs to be applied at a subsequent time.

In some embodiments of the invention, the system may be enabled to acquire simulated keyboard data through training. For example, embodiments of the invention may implement neural network methods for acquiring and storing data, which enables the system to acquire simulated keyboard parameters through training sessions. In the latter case, a system embodying the invention may be connected to a keyboard to acquire the keyboard's mechanical characteristics while a player is playing the keyboard. The data may then be used as parameter data to simulate the keyboard in question.

Thus, a method and apparatus for simulating an acoustic keyboard action in an electronic keyboard have been described. The invention is not limited to the embodiments described herein. Rather, the invention is defined by the following claims and their full scope of equivalents.

What is claimed is:

1. A method for simulating a mechanical keyboard action in an electronic keyboard, comprising:

obtaining mechanical parameters of a mechanical keyboard;

obtaining a sensor input associated with a key on an electronic keyboard;

obtaining a value representing an expected force feedback, said value obtained based on said sensor input and said mechanical parameters; and driving an actuator to impart said expected force feedback on said key.

2. The method of claim 1 wherein obtaining said sensor input further comprises sensing at least one kinetic property of said key.

3. The method of claim 2 wherein obtaining said at least one kinetic property comprises sensing a movement of said key.

4. The method of claim 2 wherein obtaining said at least one kinetic property comprises sensing a position of said key.

5. The method of claim 2 wherein obtaining said at least one kinetic property comprises sensing a force exerted on said key.

6. The method of claim 1 wherein obtaining said sensor input comprises obtaining an analog signal associated with said input.

7. The method of claim 6 wherein obtaining said analog signal comprises converting said analog signal into a digital signal.

8. The method of claim 1 wherein obtaining said mechanical parameters comprises obtaining computation data associated with a mechanical action of said mechanical keyboard.

9. The method of claim 1 wherein obtaining said mechanical parameters comprises obtaining computation data from a user-defined set of simulation parameters.

10. The method of claim 1 wherein driving said actuator comprises providing an electric current to control said actuator.

11. The method of claim 1 wherein driving said actuator comprises converting said value from a digital signal into an analog signal.

12. An electronic keyboard for simulating mechanical keyboard action, said electronic keyboard comprising:

a plurality of keys;

a plurality of sensors respectively associated with said plurality of keys;

a plurality of actuators respectively associated with said keys; and at least one processor configured to:

access mechanical parameters of a mechanical keyboard;

receive inputs from said plurality of sensors; and provide control signals to said plurality of actuators based on the mechanical parameters and the inputs from said plurality of sensors to control the plurality of actuators to simulate mechanical keyboard action of the mechanical keyboard.

13. The electronic keyboard of claim 12 wherein said plurality of sensors comprises a plurality of electromagnetic sensing devices.

14. The electronic keyboard of claim 13 wherein said a plurality of electromagnetic sensing devices comprises at least one analog-to-digital converter.

15. The electronic keyboard of claim 12 wherein said plurality of sensors comprises a plurality of optical sensing devices.

16. The electronic keyboard of claim 12 wherein said plurality of sensors comprises a plurality of combined sensors and actuators.

17. The electronic keyboard of claim 12 wherein said plurality of actuators comprises a plurality of electromagnetic actuators.

18. The electronic keyboard of claim 17 wherein said plurality of electromagnet actuators further comprises at least one digital-to-analog converter.

19. The method of claim 1 further comprising receiving a selection that identifies the mechanical keyboard.

20. The electronic keyboard of claim 12, wherein the electronic keyboard further comprises a lookup table, and wherein the processor is further configured to access the lookup table to determine values for the control signals.

21. The electronic keyboard of claim 12, wherein the electronic keyboard further comprises memory that contains instructions, and wherein the processor is further configured to execute the instructions to calculate values for the control signals based on a mathematical model of the mechanical keyboard action of the mechanical keyboard.

* * * * *